US008172565B2

(12) United States Patent
Duesel, Jr. et al.

(10) Patent No.: US 8,172,565 B2
(45) **Date of Patent: *May 8, 2012**

(54) GAS INDUCTION BUSTLE FOR USE WITH A FLARE OR EXHAUST STACK

(75) Inventors: Bernard F. Duesel, Jr., Goshen, NY (US); David L. Fenton, St. Louis, MO (US); Michael J. Rutsch, Tulsa, OK (US)

(73) Assignee: Heartland Technology Partners LLC, Kirkwood, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/259,982

(22) Filed: Oct. 28, 2008

(65) Prior Publication Data

US 2009/0053659 A1 Feb. 26, 2009

Related U.S. Application Data

(63) Continuation of application No. 11/114,493, filed on Apr. 26, 2005, now Pat. No. 7,442,035.

(51) Int. Cl.
*F23G 7/08* (2006.01)

(52) U.S. Cl. ..... 431/5; 431/202; 454/3; 454/8

(58) Field of Classification Search ..... 431/5, 202; 454/3, 8, 43, 44

See application file for complete search history.

(56) References Cited

U.S. PATENT DOCUMENTS

| | | | |
|---|---|---|---|
| 2,658,349 | A | 11/1953 | Keller |
| 3,306,039 | A | 2/1967 | Peterson |
| 3,578,892 | A | 5/1971 | Wilkinson |
| 3,730,673 | A | 5/1973 | Straitz, III |
| 3,754,869 | A | 8/1973 | Van Raden |
| 3,826,096 | A | 7/1974 | Hrusch |
| 3,838,975 | A | 10/1974 | Tabak |
| 3,901,643 | A | 8/1975 | Reed |
| 3,915,620 | A | 10/1975 | Reed |
| 3,944,215 | A | 3/1976 | Beck |
| 3,945,331 | A | 3/1976 | Drake et al. |

(Continued)

FOREIGN PATENT DOCUMENTS

JP 2003/021471 1/2003

OTHER PUBLICATIONS

International Preliminary Report on Patentability for International Application No. PCT/US2006/015803, dated Nov. 13, 2007.

(Continued)

*Primary Examiner* — Alfred Basichas

(74) *Attorney, Agent, or Firm* — Marshall, Gerstein & Borun LLP

(57) ABSTRACT

A bustle for use on a flare or an exhaust stack of, for example, a landfill gas treatment system, efficiently transfers gas from the stack to a waste heat recovery system associated with the landfill gas treatment system without substantially affecting the operation of the landfill gas treatment process. The bustle enables the heat recovery system to recover at least a portion of the energy within the exhaust produced by the gas treatment system and to provide the recovered energy either indirectly or directly to a secondary process, such as a wastewater treatment process, to thereby reduce the amount of energy needed to be otherwise input into the secondary process.

19 Claims, 9 Drawing Sheets

U.S. PATENT DOCUMENTS

| | | | |
|---|---|---|---|
| 3,947,215 | A | 3/1976 | Peterson et al. |
| 3,994,671 | A | 11/1976 | Straitz, III |
| 4,012,191 | A | 3/1977 | Lisankie |
| 4,036,576 | A | 7/1977 | McCracken |
| 4,080,883 | A | 3/1978 | Zink et al. |
| 4,092,908 | A | 6/1978 | Straitz, III |
| 4,118,173 | A | 10/1978 | Shakiba |
| 4,140,471 | A | 2/1979 | Straitz, III |
| 4,154,570 | A | 5/1979 | Schwartz |
| 4,157,239 | A | 6/1979 | Reed |
| 4,181,173 | A | 1/1980 | Pringle |
| 4,185,685 | A | 1/1980 | Giberson |
| 4,198,198 | A | 4/1980 | Straitz, III |
| 4,227,897 | A | 10/1980 | Reed |
| 4,306,858 | A | 12/1981 | Simon |
| 4,346,660 | A | 8/1982 | McGill |
| 4,430,046 | A | 2/1984 | Cirrito |
| 4,445,464 | A | 5/1984 | Gerstmann et al. |
| 4,445,842 | A | 5/1984 | Syska |
| 4,450,901 | A | 5/1984 | Janssen |
| 4,485,746 | A | 12/1984 | Erlandsson |
| 4,496,314 | A | 1/1985 | Clarke |
| 4,538,982 | A | 9/1985 | McGill et al. |
| 4,583,936 | A | 4/1986 | Krieger |
| 4,652,233 | A | 3/1987 | Hamazaki et al. |
| 4,658,736 | A | 4/1987 | Walter |
| 4,771,708 | A | 9/1988 | Douglass, Jr. |
| 4,890,672 | A | 1/1990 | Hall |
| 4,909,730 | A | 3/1990 | Roussakis et al. |
| 4,952,137 | A | 8/1990 | Schwartz et al. |
| 4,961,703 | A | 10/1990 | Morgan |
| 5,279,356 | A | 1/1994 | Bruhn |
| D350,838 | S | 9/1994 | Johnson |
| 5,347,958 | A | 9/1994 | Gordon, Jr. |
| 5,460,511 | A | 10/1995 | Grahn |
| 5,527,984 | A | 6/1996 | Stultz et al. |
| 5,735,680 | A | 4/1998 | Henkelmann |
| 5,749,719 | A | 5/1998 | Rajewski |
| 5,810,578 | A | 9/1998 | Hystad |
| 5,968,320 | A | 10/1999 | Sprague |
| 6,250,916 | B1 | 6/2001 | Philippe et al. |
| 6,276,872 | B1 | 8/2001 | Schmitt |
| 6,345,495 | B1 | 2/2002 | Cummings |
| 6,632,083 | B1 | 10/2003 | Bussman et al. |
| 6,742,337 | B1 | 6/2004 | Hays et al. |
| 7,442,035 | B2 * | 10/2008 | Duesel et al. ..... 431/5 |
| 2004/0031424 | A1 | 2/2004 | Pope |
| 2004/0045682 | A1 | 3/2004 | Liprie |

OTHER PUBLICATIONS

International Search Report for International Application No. PCT/US2006/015803, dated Oct. 30, 2007.

Non-final office action for U.S. Appl. No. 11/114,493, dated Sep. 26, 2007.

Final office action for U.S. Appl. No. 11/114,493, dated Mar. 3, 2008.

Non-final office action for U.S. Appl. No. 11/114,822, dated Oct. 30, 2007.

Final office action for U.S. Appl. No. 11/114,822, dated Apr. 7, 2008.

Non-final office action for U.S. Appl. No. 11/114,822, dated Aug. 22, 2008.

Final office action for U.S. Appl. No. 11/114,822, dated Apr. 8, 2009.

* cited by examiner

GAS INDUCTION BUSTLE FOR USE WITH A FLARE OR EXHAUST STACK

RELATED APPLICATIONS

This application is a continuation of and claims priority to U.S. patent application Ser. No. 11/114,493 (U.S. Pat. No. 7,442,035) which was filed on Apr. 26, 2005, the entirety of which is hereby incorporated by reference herein.

FIELD OF THE DISCLOSURE

This disclosure relates generally to waste heat recovery systems, and more particularly to bustles used in a waste heat recovery system for use at a landfill or other industrial site where hot gas generated in combustion processes is exhausted to the atmosphere.

BACKGROUND

The decomposition of organic matter in landfills produces significant amounts of gas, primarily methane and carbon dioxide, along with trace amounts of other organic gases and certain contaminants. When landfill gas migrates through soil or is released into the atmosphere it presents safety hazards related to the potential to form explosive mixtures of methane and air, and environmental hazards related to the release of methane and other pollutants. Landfill gas can also create nuisance odors within and beyond the landfill boundaries. For these reasons, federal and state regulations require that landfill owners provide positive means to control migration and release of landfill gas. Accordingly, gas collection wells are usually placed vertically in a landfill to collect the gases produced during the decomposition process, and these wells are connected together by a gas pipeline system that transports the collected gas including the entrained contaminants to a convenient location for beneficial use or disposal.

Disposal of the landfill gas is normally accomplished by burning the gas within an enclosed or open flare. Beneficial use of landfill gas can take a variety of forms with the most common being fuel for engines that generate electricity, fuel for landfill leachate evaporation systems, or direct sale of the gas for off-site applications such as fuel for industrial boilers or electrical generators. Government regulations dictate at what temperatures the gas must be burned and for how long the gas must be exposed to the prescribed temperatures based on air quality standards. The regulations are designed to assure that the gas and the contaminants therein are destroyed prior to being released to the atmosphere. Where regulations require the use of an enclosed flare, the landfill gas is typically burned at the bottom of the flare stack, which is designed to maintain the gas undergoing treatment in the combustion process at a relatively high temperature (e.g., usually around 1500° F., typically between 1400° F. to 1800° F. and in some cases between 1200° F. and 2200° F.). The volume of the flare stack is selected to provide enough residence time, such as between 0.3 and 1.5 seconds, to ensure adequate treatment of the components within the gas. The difference in temperature from the bottom of the flare stack to the top of the flare stack is normally quite small, meaning that the exhaust gas ejected out of the top of the flare stack is still very hot and thus contains significant heat energy. Likewise, due to inherently poor thermodynamic efficiency, both internal combustion engines and turbines fueled by landfill gas eject significant heat energy to the atmosphere in the form of exhaust gas at temperatures that are typically in the range of 750° F. to 1150° F. and almost always in the range of 600° F. to 1200° F.

Because this energy is simply released to the atmosphere, it is referred to as waste energy or waste heat. Where exhaust gas is at a relatively high temperature such as 600° F. to 2200° F. and the quantity of the hot gas is such that the total energy content amounts to all or a significant portion of that required to operate a desirable downstream process, opportunities exist to beneficially use the waste heat. Regardless of whether a gas is simply flared or employed within a process for beneficial use, very few systems are designed to recover and beneficially utilize any of the waste heat exiting a flare stack or combustion engine at, for example, a landfill.

SUMMARY

A waste heat recovery system is coupled to a flare stack or an exhaust stack of a primary process, for example, a landfill gas treatment system, to recover at least a portion of the energy within the exhaust produced by the gas treatment system and provides the recovered energy to a secondary process to thereby reduce the amount of energy needed to be otherwise input into the secondary process. In one embodiment, a waste heat recovery system includes a transfer pipe, an induction fan, a heat exchange unit and a secondary exhaust stack. Generally speaking, the transfer pipe is connected to a stack bustle disposed between an exhaust or flare stack of a primary process, such as a landfill gas treatment system, and a secondary process which may be a wastewater treatment unit, a chemical treatment unit or any other process that can utilize the waste heat. The induction fan is positioned within or connected to the transfer pipe and operates to create a draft within the stack bustle and the transfer pipe to facilitate movement of some of the exhaust gas from the flare or exhaust stack of the primary process to the heat exchange unit or directly to a secondary process. When used, the heat exchange unit transfers energy in the diverted exhaust gas to the secondary process using for example a heat transfer fluid, and the secondary exhaust stack vents the exhaust gas passed through the heat exchange unit to the atmosphere.

Preferably, the transfer pipe is connected to the flare or exhaust stack of the primary process through a bustle which is designed to operate in conjunction with the induction fan and possibly a control damper to divert exhaust gases to the transfer pipe in a manner that does not significantly affect the back pressure or exhaust gas flow pattern within the flare or exhaust stack. This operation helps to assure that the transfer of exhaust gas from the primary stack to the heat transfer unit does not negatively affect operation of the primary process.

Additionally, a method for recovering waste heat from a primary process includes transferring an amount of exhaust gas from a primary process to a secondary process, utilizing at least some of the energy in the transferred exhaust gas within the secondary process and venting the exhaust gas to, for example, the atmosphere through a secondary exhaust stack. If desired, transferring exhaust gas from the primary process may include using an induction fan and a bustle to create a draft at the exhaust end of the stack of the primary process to facilitate the transfer of the exhaust gas from the stack of the primary process without significantly affecting the back pressure or gas flow within the exhaust stack of the primary process.

During operation, the disclosed system or method recovers energy from one or more primary processes and applies the recovered energy either directly or indirectly to one or more secondary processes without adversely affecting the operation of the primary process or processes. If desired, the disclosed system and method may use the recovered heat energy to treat a variety of wastewater streams, to recover products from wastewater, to chemically treat wastewater, to provide space heating for buildings, etc. The energy recovered from the primary process may be originally generated as a result of the combustion of low grade fuels, such as biogas generated in landfills, and the results of the combustion may be obtained by diverting stack gas from flares or exhaust stacks used in landfill or petroleum operations to a heat transfer system. If desired, however, the diverted stack gases may be used directly in a secondary process to facilitate physical changes and/or chemical reactions within the secondary process.

Figure 1:
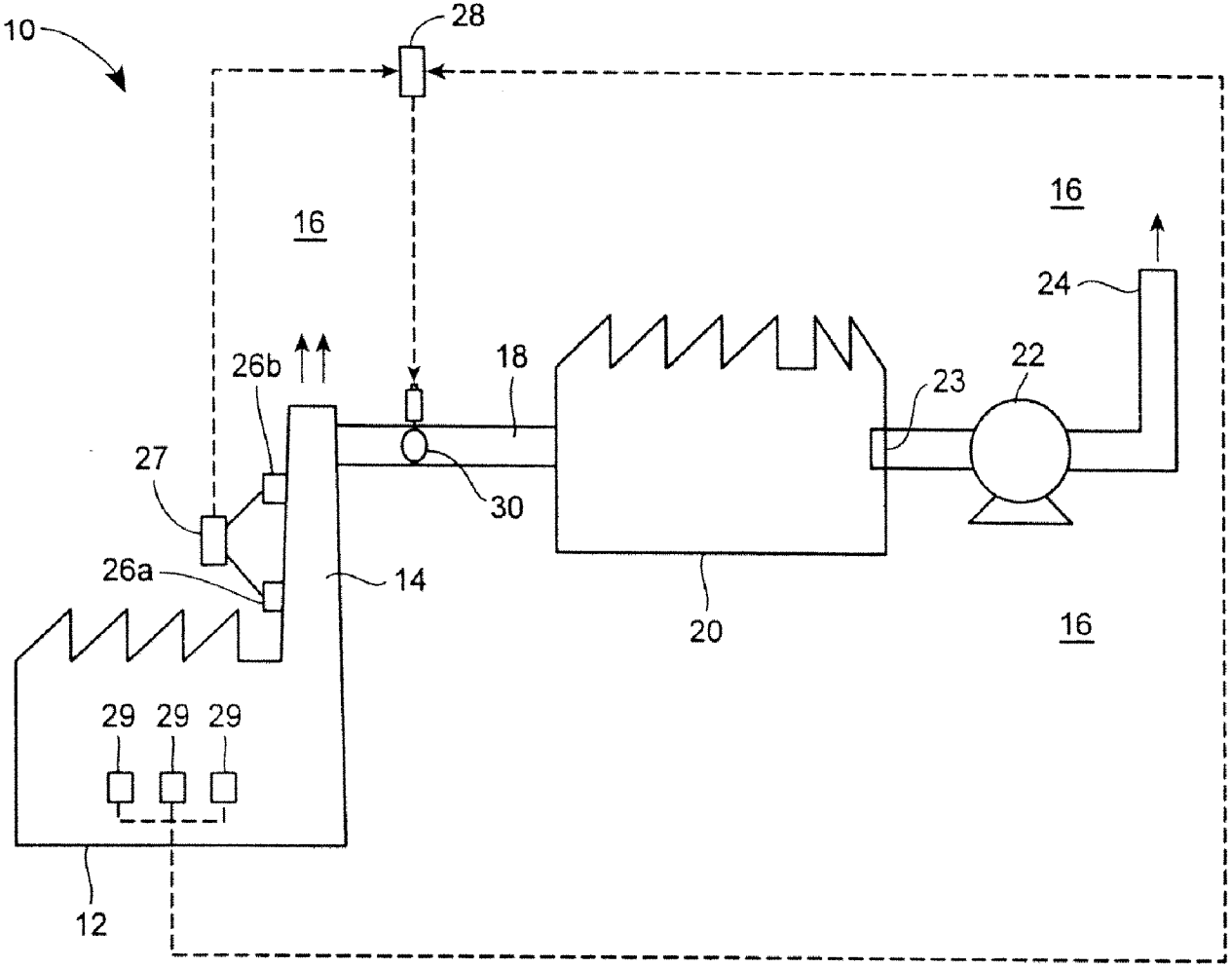
FIG. 1 is a partial block, partial schematic diagram of an example waste heat recovery system.

While the methods and devices described herein are susceptible to various modifications and alternative constructions, certain illustrative embodiments thereof are depicted in the drawings and will be described below in detail. It should be understood, however, that there is no intention to limit the invention to the specific forms disclosed in the drawings. To the contrary, the intention is to cover all modifications, alternative constructions, and equivalents falling within the spirit and scope of the invention as defined by the appended claims.

DETAILED DESCRIPTION

Referring to FIG. 1, a waste heat recovery system 10 recovers heat energy created in a primary process 12 and delivers this energy to a secondary process 20 either directly or through the use of a heat transfer fluid. More particularly, the waste heat recovery system 10 siphons or diverts a portion of exhaust gas from the top of a flare or exhaust stack 14 associated with the primary process 10 and provides this diverted exhaust gas to the secondary process 20, which captures and uses energy in the form of heat extracted from the diverted exhaust gas. In this manner, the energy recovered from the diverted exhaust gas is applied either directly or indirectly to one or more elements within the secondary process 20 without significantly interfering with the operation of the primary process 10. As will become apparent, waste energy recovery systems such as that depicted in FIG. 1 may be employed in series with other waste energy recovery systems, wherein the secondary process of a first waste energy recovery system becomes the primary process of a second waste energy recovery system, and so on.

As is known, waste energy (typically in the form of heat energy) is generated by a primary process 12, which may be a landfill gas treatment system, and is typically exhausted out of the flare or exhaust stack 14 to the atmosphere 16. However, the energy recovery system of FIG. 1 captures a portion of the exhaust gas within the flare or exhaust stack 14 and diverts this gas through a transfer pipe 18 to the secondary process 20. As illustrated in FIG. 1, an induction draft fan 22 is coupled to the exhaust vent 23 of the secondary process 20 to facilitate transfer of the exhaust gas through the transfer pipe 18 to the secondary process 20 and the induction draft fan 22 vents the exhaust gas through a secondary exhaust 24 to the atmosphere 16. While not shown, the secondary exhaust 24 could instead be connected to a further process or heat recovery system which could recover additional energy from the gas exhausted through the exhaust 24.

The waste energy recovery system 10 may include one or more sensors 26*a* and 26*b* located at different positions along the stack 14 that operate to detect one or more conditions of the gas within the exhaust stack 14, such as, for example exhaust gas pressure, combustion temperature, fuel consumption, flow rate, or any other condition of the gas within the exhaust stack 14. The sensors 26*a* and 26*b* may be connected to a differential sensor 27 that detects or measures the difference between the measurements made by the sensors 26*a* and 26*b* to determine for example the difference in the pressure of the gas in the stack 14 to thereby determine gas flow rate in the stack 14 between the locations measured by the sensors 26*a* and 26*b*. The sensor 27 may be connected to a controller 28 which, in turn, controls a variable motor-driven damper 30. The controller 28, which may be communicatively connected to other sensors besides the sensor 27, such as one or more sensors 29 in the primary process 12, implements any desired control routine to operate the damper 30 which, in turn, controls the rate (or volume) of exhaust gas transferred to the secondary system 20 through the transfer pipe 18. If desired, the controller 28 may also or instead be connected to and control the rate of the induced draft fan 22 either in conjunction with or apart from the damper 30 to thereby have further control over the rate at which exhaust gas is transferred from the exhaust stack 14 to the transfer pipe 18.

Generally speaking, the controller 28 operates to ensure that the quantity of the exhaust gas, and the manner by which the exhaust gas is transferred to the secondary process 20 does not adversely affect the performance of the primary process 12 and, in particular, may operate to keep the back pressure in the stack 14 at a desired or acceptable value based on, for example, operational parameters of the primary process 12, such as combustion gas flow, exhaust gas flow, engine speed, etc. The sensors 26*a* and 26*b* provide indications of properties of the exhaust gas while the sensors 29 provide performance parameters which indicate the performance of the primary process 10. Examples of primary process performance parameters include, but are not limited to, combustion rate, exhaust gas flow pattern, static pressure at the pickup point, temperature, etc.

Figure 2:
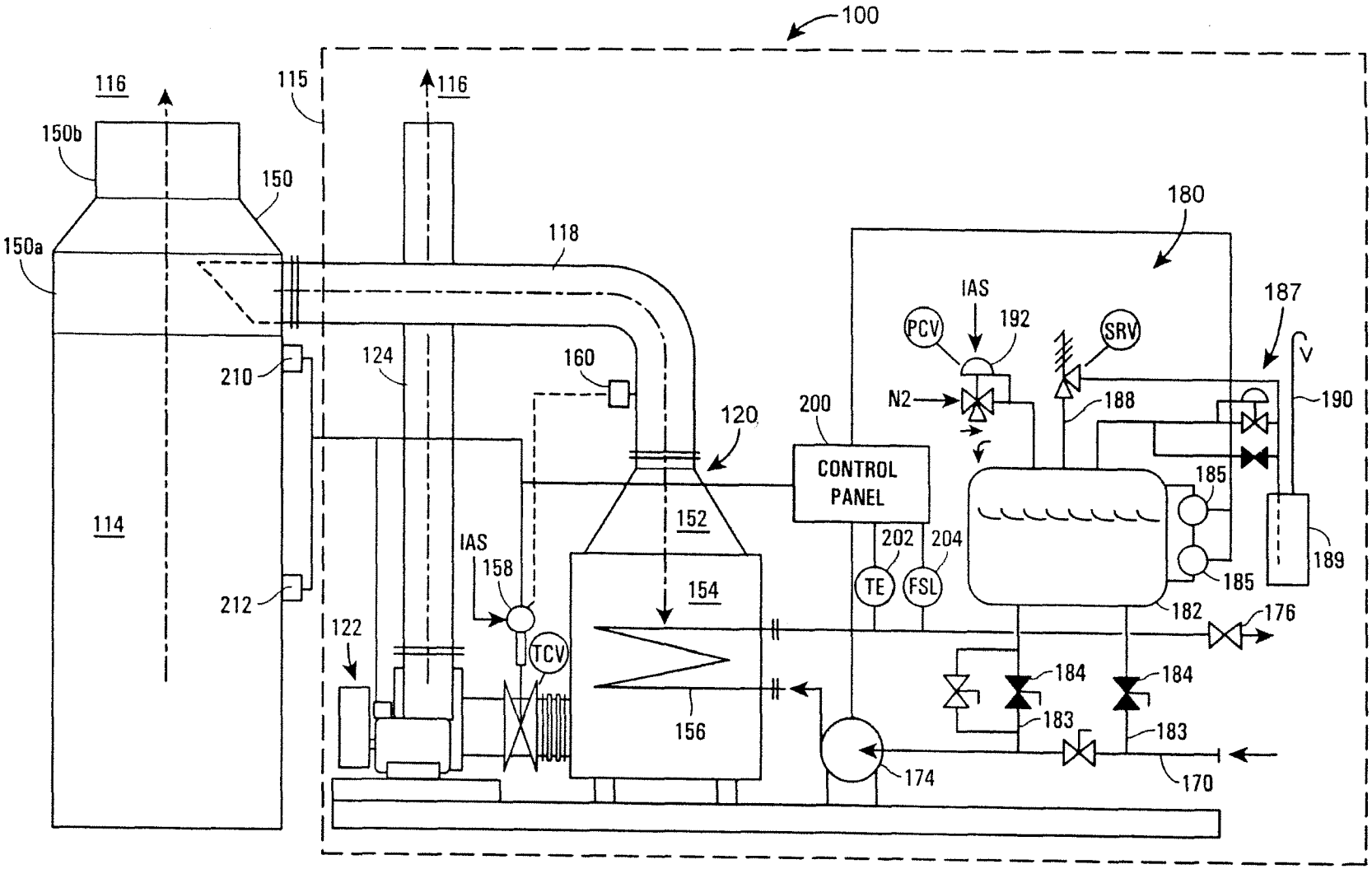
FIG. 2 is a detailed schematic diagram of a waste heat recovery system used to transfer heat from a flare stack of a landfill gas treatment system to a secondary process using a transfer fluid.

FIG. 2 depicts a more detailed example of a waste energy recovery system 100 connected between a flare stack 114 of, for example, a landfill gas treatment system and a heat exchange unit 115 that is connected in series with a secondary process (not shown in FIG. 2). Landfill gas is introduced into a bottom portion of the flare stack 114 and is burned as the gases rise from the bottom of the flare stack 114 to the top of the flare stack 114. Due to environmental regulations, the flare stack 114 is designed to maintain the landfill gases at a relatively constant temperature throughout the flare stack (such as between 1200 and 2200 degrees Fahrenheit or, more particularly, 1400 and 1800 degrees Fahrenheit) for a particular amount of time, such as between 0.3 and 1.5 seconds, in order to thoroughly combust the flammable components of the landfill gas and thermally oxidize any contaminants entrained therein. Because of this feature of landfill flare stacks 114, the exhaust gas at the top of the flare stack 114 is very rich in heat energy. As will be understood from FIG. 2, a portion of the exhaust gas that would normally exit the top of the flare stack 114 is instead transported via a transfer pipe 118 to a heat exchanger 120. An induced draft fan 122 operates to create a negative pressure or a draft at the inlet of the transfer pipe 118 to draw some of the exhaust gas within the flare stack 114 through the transfer pipe 118 and the heat exchanger 120. The fan 122 then expels the diverted gas through a secondary exhaust stack 124 to the atmosphere 116 after that gas has passed through the heat exchanger 120.

The waste energy recovery system 100 depicted in FIG. 2 includes a flare stack cap or bustle 150 which is disposed at the top of the flare stack 114 and is designed to create an appropriate draft at the hot gas transfer point within the flare stack 114 to thereby assist in forcing a portion of the exhaust gas into the transfer pipe 118. The bustle 150 depicted in FIG. 2 includes a first portion 150*a* that is the same size or diameter as the flare stack 114 and that is adapted to be fit onto or over the top of the flare stack 114, a reduced in cross-section portion 150*b* that has a smaller diameter or cross section than the portion 150*a* and a connecting portion that tapers to connect the first and second portions 150*a* and 150*b* together. The transfer pipe 118 enters through an aperture in the section 150*a* of the bustle 150 and includes an elongated entrance designed to create a localized draft in the vicinity of the entrance of the transfer pipe 118. While a portion of the exhaust gas in the flare stack 114 continues to exit the flare stack 114 through the bustle portion 150*b*, some of the exhaust gas within the flare stack 114 is caused by the draft created in the bustle 150 by the operation of the induced draft fan 122 to enter into the transfer pipe 118 and flow through the heat exchanger 120.

As depicted in FIG. 2, the heat exchanger 120 includes a nozzle 152 and a chamber 154 wherein gases within the chamber 154 pass over a series of pipes 156 filled with a process or heat transfer fluid that is continuously recirculated through the heat exchange unit 115 and the secondary process (not shown in FIG. 2.). Generally speaking, the fluid within the pipes 156 is colder than the exhaust gas and thus, heat is transferred from the exhaust gas to the transfer fluid as the exhaust gas passes over the pipes 156. After passing over the pipes 156, the partially cooled exhaust gas exits the chamber 154 through a modulating damper 158 which maintains the proper or desired flow rate of the exhaust gas through the heat exchanger 120. After passing through the modulating damper 158, the exhaust gas continues through the induction or induced draft fan 122, which creates a draft throughout the chamber 154 of the heat exchanger 120 and the transfer pipe 118 to draw the exhaust gas through the heat exchanger 120. Because the exhaust gas entering into the transfer pipe 118 has been fully processed, i.e., has been within the flare stack 114 for long enough and at a temperature high enough to fully or adequately burn the gas and thermally oxidize the contaminants entrained therein, there is no need to process the gas exiting the heat exchanger 120. Thus, this gas can be released directly to the atmosphere 116. Of course, this gas may be provided to any combination of one or more other heat exchange units and associated secondary processes which operate at lower temperatures than the exhaust gas to extract more energy from this gas.

As depicted in FIG. 2, the heat exchange unit 115 may include a heat transfer fluid line 170 that is used to transfer heat energy to any combination of one or more secondary processes (not shown in FIG. 2). Heat transfer fluid, which may be for example, Therminol® or any other desired or known fluid that can be cycled through large temperature changes and remain stable, may be supplied to the line 170 at a temperature colder than that of the exhaust gas in the heat exchanger 120, and may be recirculated by a pump 174 to the line 156 and back out to one or more secondary processes (not shown) through a valve 176. Recirculation of heat transfer fluid occurs when pipes (not shown) from one or more secondary processes (not shown) conduct the heat transfer fluid back to the line 170. When, for example, Therminol is used as a process transfer fluid, a Therminol module 180 may include a storage and expansion tank 182 connected to the line 170 via the valves 184 and the lines 183 to assure that an adequate supply of transfer fluid within the line 170 and any lines and systems (not shown) connected to the line 170, and to allow for expansion or contraction of the transfer fluid within the line 170 and any lines and systems connected to the line 170. Generally speaking, level sensors 185 may be used to detect the level of the transfer fluid within the tank 182 to assure that there is an adequate supply and not an overfill condition within the combination storage-expansion tank 182. Overflow valves 187 and an overflow reservoir 189 may be used to reduce or eliminate excess transfer fluid or pressure from building up within the tank 182. A level sensor 190 within the overflow tank 189 may be used to detect the level of fluid within the overflow tank 189 for safety purposes. Additionally, it is sometimes desirable to provide a nitrogen ($N_2$) blanket on top of the transfer fluid within the tank 182. In this case, a nitrogen ($N_2$) supply may be connected to the tank 182 via a valve system 192 to provide and keep a nitrogen blanket on the top of the transfer fluid in the tank 182 and the sensors 185 may be used to detect the proper levels of the transfer fluid.

Additionally, a controller or a control panel 200 may be connected to various components of the system of FIG. 2 to control the operation of the waste heat transfer system 100 as well as to control the process fluid within the heat exchange unit 115 and any lines and secondary processes connected to the system. In particular, the controller 200 may be connected to the sensors 185, to the pump 174 and to various sensors such as a temperature sensor 202 and a flow sensor 204 which measure the temperature and flow of the heat transfer fluid at the exit of the heat exchanger 120. The controller 200 may implement a first control routine to produce a control signal delivered to the pump 174 to control the speed of the pump 174 and thereby the flow of the transfer fluid within lines 156 and 170 to control the temperature of the transfer fluid at the output of the heat transfer unit 120 to be at a desired temperature. This temperature may be based on the desired heat transfer characteristics of the transfer system. In addition, the controller 200 may control the operation of the valve 192 and the valve 187 based on measurements made by the sensors 185, 202 and 204 to control the amount of nitrogen and transfer fluid disposed within the tank 182 or the amount of fluid flowing within the line 170.

The controller 200 may also be communicatively connected to one or more sensors 210, 212 which measure temperature, pressure or other characteristics of the gas within the flare stack 114 and may apply any desired control scheme to control the operation of the modulating damper 158 and the speed of the induced draft fan 122 to control the flow of gas from the flare stack 114, through the transfer pipe 118 and into the heat exchanger 120. In the primary process, where a particular exhaust pattern and/or pressure or pressure differential in the flare stack 114 may be required or at least desired, the controller 200 operates the induction fan 122 and the valve 158 to provide an adequate draft in the transfer pipe 118 to maintain the static pressure at all locations within the bustle 150 at substantially the same values that occur when the heat exchanger 120 is not operating. In this manner, the overall effect on the exhaust flow pattern and flare stack pressure caused by the operation of the heat transfer system will be minimized or eliminated. Accordingly, the primary process will operate normally and is not significantly affected by the bustle 150 and/or the induction fan 122. In this manner, the controller 200 operates to control the amount of heat energy transferred from the exhaust of the primary process to the secondary process by controlling the flow of and exit temperature of the transfer fluid in the heat exchange unit 115, the flow of exhaust gas from the exhaust stack 114 of the primary process to the heat exchanger 120 or both.

While the waste energy recovery system has been described in general terms with respect to a primary process, a heat exchange unit and secondary processes, the waste energy recovery system may specifically be employed in primary processes including, but not limited to, incinerators or flares which emit hot stack gases, engines such as internal combustion engines, turbines and reciprocating engines used in, for example, waste gas disposal systems at landfills and/or petroleum production facilities, etc. Preferably, the fuel used in the primary process is renewable or easily recovered, such as landfill gas. However, the waste heat recovery system may also be used with primary processes which use conventional fuels such as coal, wood, oil and natural gas.

Furthermore, the heat or waste energy recovered from the primary process may be used directly, or indirectly employing a heat exchange unit and recirculated heat transfer fluid in secondary processes which may be, for example, chemical processes or wastewater treatment units, or any combination of these and other desired types of processes. A manner of using the recovered energy indirectly in a secondary process is illustrated in FIG. 2, wherein heat energy from the primary process is first transferred to a heat transfer fluid and is, from there, delivered to one or more secondary processes. In this case, the exhaust gas from the primary process is circulated around a series of pipes which contain a heat transfer fluid. Different types of heat transfer fluids may be used, and potential heat transfer fluids include, but are not limited to, steam, water and commercially available heat transfer fluids such as Dowtherm® and Therminol®. Of course, almost any liquid could conceivably be used as a heat transfer fluid and one skilled in the art could choose an appropriate fluid based on the exhaust gas temperature and secondary process requirements. Examples of secondary processes which use recovered energy indirectly with the use of a heat transfer fluid include, but are not limited to evaporation processes that may be employed to recover solvents from industrial waste streams, steam strippers, humidification systems, dehydrators, chemical reactors, dryers, reactors, absorbers, refrigeration systems, freeze protection systems, space heaters and hot water heaters.

Alternately, the exhaust gas from the primary process may be used directly in a secondary process. Examples of this use of the waste heat include submerged gas evaporators, spray dryers, sludge dryers or processes that utilize components of the stack gas directly to promote or take part in a chemical reaction. Further, the exhaust gas from the primary process may be provided to venturi devices used for contacting gas and liquid or reactors used to treat wastewater. In some cases, the residual for final disposal or combinations of residual and salable products may be recovered by such systems. Wastewater treatment in submerged hot gas evaporators and venturi devices used for contacting gases and liquid may rely on evaporation and/or any combination of evaporation and chemical reactions between constituents in the primary process exhaust gas and constituents of the wastewater. Alternately, one or more additional reactants may be added to the exhaust gas or directly into the submerged gas or venturi reactor to achieve desired characteristics in a final product and/or residual.

One skilled in the art will recognize that the waste energy recovery system of FIGS. 1 and 2 have utility over a broad spectrum of applications including, for example, treating wastewater streams either with or without recovery of salable products. In fact, any combination of primary and secondary processes may be located in close proximity to one another at a site which provides a source of low cost fuel, such as, for example, landfills or petroleum refineries. Specifically, at landfills, wastewater may be delivered by truck or rail, or be transferred from a nearby facility via a pipeline. Petroleum refineries provide opportunities for low cost fuel plus the potential of supplying wastewater for treatment directly from on-site operations.

The system described with respect to FIGS. 1 and 2 provides direct opportunities to reduce consumption of non-renewable fuels while conserving renewable fuels through recovery of heat energy from primary processes for use in secondary processes. For example, the system may be used to improve the efficiency of manufacturing products that generate waste streams containing solvents, especially where excess quantities of solvent are employed to drive chemical reactions to completion. Efficient recovery and reuse of solvents from such wastewater streams can significantly reduce the cost of manufacturing the products.

Figure 3:
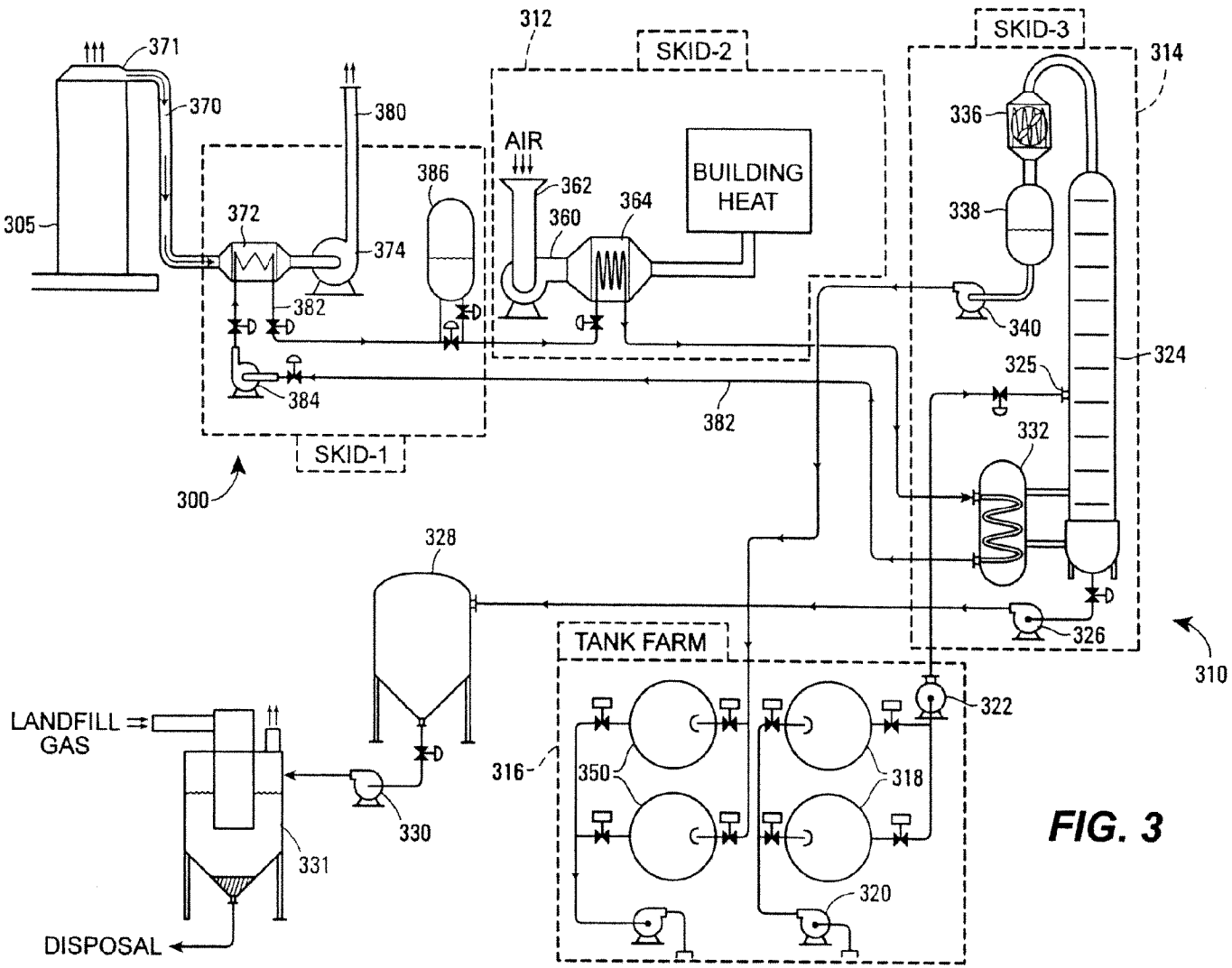
FIG. 3 is a schematic diagram of a waste heat recovery system coupled between a flare or exhaust stack of a primary process and multiple portions of a secondary process to provide energy from waste heat to multiple different sections of the secondary process.

Referring now to FIG. 3, a waste heat exchange system 300 is illustrated as being connected between a flare stack 305 and multiple portions of a secondary process 310 which, in this case, is illustrated as a distillation process for recovering solvent. The heat exchange system 300 is disposed on a first skid (Skid 1) while portions of the solvent processing system 310 are disposed on other skids 312 and 314, marked as Skid 2 and Skid 3, connected to a tank farm 316. In the system depicted in FIG. 3, a wastewater mixture containing solvent having a boiling point less than that of water is delivered to and stored within tanks 318 in the tank farm 316 via an input pump 320 which may be permanently or removably connected to delivery trucks, railroad cars, a pipeline structure, etc.

When desired or needed, a feed pump 322 delivers the wastewater stored in the tanks 318 to a distillation column 324 located on Skid 3, which is used to purify the solvent. In particular, the pump 322 delivers the wastewater to an inlet 325 of the distillation column 324. The location of the inlet 325 in reference to the height of the distillation column 324 is dependent on the design of the distillation column 324, the characteristics of the wastewater and the desired quality of the recovered solvent. The wastewater is at varying temperatures depending on the location along the length of the distillation column 324 the temperature being highest at the bottom and lowest at the top. Mixtures of vapor and liquid in equilibrium at varying temperatures and pressures within the distillation column 324 are increasingly enriched in the solvent at locations above the inlet 325 and are increasingly depleted in the solvent at locations below the inlet 325. Thus, the purity of the solvent is continuously increased in a known manner as the flow approaches the top of the distillation column 324. Concurrently, substances that are less volatile than the solvent, which may or may not include recoverable substances, settle to the bottom of distillation column 324 during the refining process. A pump 326 located at the bottom of the distillation column 324 transfers the less volatile fraction to a bottoms receiver tank 328 where the material may be stored and/or processed in any desired manner. As part of this processing, a pump 330 may be used to transfer all or a portion of the material in the receiver tank 328 to, for example, an evaporator 331 which may further evaporate or condense the material. The output of the evaporator 331, which is illustrated in FIG. 3 as a submerged combustion gas evaporator, may be further processed in any desired manner and/or may be disposed of in, for example, a landfill.

Heat is provided to the distillation column 324 via a heat exchanger 332, which supplies heat to the bottom portion of the distillation column 324 to thereby cause the separation of solvent and sludge within the distillation column 324. An air-cooled condenser 336 located at the top of the distillation column 324 cools and condenses the pure or nearly pure solvent and provides this condensed solvent to a receiver tank 338 located on Skid 3. A pump 340 pumps the recovered condensed solvent from the tank 338 to one or more product storage tanks 350 within the tank farm 316, where the purified solvent may be transferred through pump 352 to trucks, railroad cars, pipelines, etc. and delivered to a final destination.

As depicted in FIG. 3, an air intake fan 360 is located on Skid 2 and operates to draw air from, for example, the atmosphere, through an air intake 362 and to force the air through a heat exchanger unit 364 where this air is heated. The heated air provided at the output of the heat exchanger unit 364 may then be used to provide heat within buildings located close to Skid 2 (not shown) or for other purposes.

The heat exchange system 300, located on Skid 1, includes a transfer pipe 370 connected to a bustle 371 disposed on or at the top of the flare stack 305 or other exhaust stack associated with a primary process. The flare stack 305 may be, for example, a flare stack of a traditional landfill gas treatment system, may be an exhaust stack of an engine that operates using low grade or contaminated fuels, such as landfill gas, or may be an exhaust stack associated with any other source of heat energy. The bustle 371 captures some of the exhaust gas within the flare stack 305 and delivers this captured exhaust gas via the transfer pipe 370 to a heat exchanger 372. The capture of the exhaust gas is aided by an induction fan 374, or other type of fan, which exhausts gas out of a secondary exhaust stack 380. Because the gas captured by the bustle 371 and ported through the heat exchanger 372 has been fully and completely processed in the flare stack 305 according to applicable regulations, the exhaust from the heat exchanger unit 372 may be released directly to the atmosphere, or may be used in other processes.

Generally speaking, the induction fan 374 operates to draw waste heat gas from the flare stack 305, which in a landfill treatment situation is typically at 1400° F. to 1600° F., and delivers this gas to the heat exchanger 372 at approximately the same temperature. The heat exchanger 372 operates to transfer a portion of the heat energy of the exhaust gas diverted from the flare stack 305 to a process fluid or to a heat transfer fluid within a fluid transfer pipe 382. A combination storage-expansion tank 386 with appropriate control systems is connected to the pipe 382 to assure an adequate supply and not an overfill condition of process fluid or transfer fluid in the pipe 382 and any systems connected to the pipe 382, which in this depiction includes the three heat exchangers 332, 364 and 372. In one case, the operation of the heat exchanger 372 and the transfer fluid may reduce the temperature of the gas in the secondary exhaust stack 380 to approximately 700-730° F., thereby recapturing a great deal of the heat energy within the exhaust gas drawn through the heat transfer unit 372.

A pump 384 pumps the heat transfer fluid in the pipe 382 through various valves to both the heat exchanger 364 and the heat exchanger 332, where the energy in the transfer fluid in the form of heat is used or transferred to other stages of the solvent distillation process or the integrated building heating system as described previously. In particular, after exiting the heat exchanger 372, the transfer fluid within the pipe 382 may be provided at approximately 600° F. to the heat exchanger 364. Some of the heat energy within the heat transfer fluid is transferred to the air provided by the fan 362. In one embodiment, the heat transfer unit 364 may heat the air to approximately 90° F., and this heated air is used for space heating within a building or buildings located close to Skid 2.

Still further, the transfer fluid output from the heat transfer unit 364 which may be at, for example, approximately 500° F. to 575° F. is provided to an input of the heat exchanger 332 where some of the remaining energy in this fluid is transferred to the distillation column 324 and used in the distillation process to recover solvent. The transfer fluid output from the heat exchanger 332, which may be at, for example, approximately 150° F. to 300° F. is then recirculated by the pump 384 back through the heat transfer unit 372 to be reheated to approximately 600° F. While the heat transfer fluid of FIG. 3 has been described as being cycled between approximately 150 and 600 degrees Fahrenheit, it is considered that the heat transfer system described herein can be advantageously used to cycle heat transfer fluids at any temperatures between approximately 150 and 1500 degrees Fahrenheit.

As will be noted, in the heat exchange unit 300 of FIG. 3, the waste energy in the exhaust gas from the flare stack 305 is provided to multiple different sections of a secondary process, in this case, a solvent treatment process with an integrated system for heating buildings, and the waste energy is transferred to gas (such as air), liquids or other fluids used in the secondary process using one or more heat exchangers. Of course, the fluid transfer line 382 may be connected to other heat transfer units for providing energy in the form of waste heat in the flare stack 305 to other types of processes besides solvent treatment processes, and can be connected to any desired number of different secondary processes or any number of sections or portions of a secondary process depending upon the amount of waste heat energy available and the amount transferred in any particular heat transfer exchange within the secondary process. Still further, while the schematic of FIG. 3 illustrates one use of a heat transfer system wherein heat energy from a stack is collected at 1400° F. to 1600° F. and is reduced in further stages in heat exchange units and secondary processes, this heat transfer system could be used with other flare or exhaust stacks operating at other temperatures and could provide energy via other types of heat transfer systems at various temperatures, pressures, etc. as desired and needed for any specific process. Still further, while the exhaust gas of the heat exchange unit 300 is expelled through the secondary exhaust 380 to the atmosphere at about 700-750° F., the exhaust gas out of the secondary exhaust 380 could instead be expelled at other temperatures and could also be provided to one or more further heat exchanger(s) so that the energy within the exhaust of the heat exchange unit 300 could be used in additional or other processes as desired or needed. In one example, the exhaust gas from the secondary exhaust 380 could be piped to and used directly within an evaporator, dehydrator, etc. For example, in the system of FIG. 3, the exhaust from the stack 380 may be provided to the evaporator 331 and used instead of, or in combination with combustion gas produced by an additional combustion system within the evaporator 331.

Of course, the use of waste energy from the flare stack 305 is not limited to a single stage heat transfer process, but can include the use of multiple stages of heat transfer systems connected in series to the output of the flare stack 305 to provide or obtain energy from the flare stack for multiple different processes, or for multiple different uses within the same process, etc.

Still further, as indicated in the process of FIG. 3, the heat transfer unit 300 may be located on a first skid set adjacent to the flare or exhaust stack 305 and the secondary process may be configured to be set on one or more other skids which can be easily placed adjacent to or near to the first skid. Once delivered to the site, the heat exchange unit 300 needs only to be connected via piping to the flare stack 305 and to the different portions of the secondary process 310, which makes transportation, assembly and installation of the heat exchange unit 300 and the secondary process 310 simple and convenient. Additionally, the use of separate and moveable skids allows the secondary process to be moved, changed or switched out for a different process if need be, thereby allowing the heat recovered by the heat transfer system 300 to be easily applied to different secondary processes at different times, depending on the greatest need or best use of this recovered heat energy.

Thus, the systems described herein recover waste heat or waste energy from the burning of low-grade or low-cost fuels, such as landfill gases which, heretofore have been simply released to the atmosphere, and do so by placing a heat exchange unit between a flare or exhaust stack of a primary process and one or more components of a secondary process which, preferably, is located close to the flare or exhaust stack. These systems reduce or eliminate entirely the amount of energy that must be independently provided to the secondary process via more costly energy sources. Still further, as noted above, it is preferable to place the secondary process using the recovered waste energy in close proximity to the flare or exhaust stack, such as that of a landfill, to efficiently use the recovered energy. However, placing the secondary process close to the primary process is also desirable because it locates chemical and other wastewater processing systems close to or even on the same land as the primary process, which consolidates these different processes in the same geographical area. In the case of landfills, this consolidation enables commercial processing operations to be collocated on real estate, such as on landfill property, which typically has very little other uses, and thus consolidates the commercial activities associated with processing what are typically considered to be noxious or undesirable fluids (liquids and gases) while simultaneously saving energy in the processing of those fluids. Still further, the use of skids for locating the secondary process close to the primary process enables the secondary processes to be easily moved, changed, etc. during the life of the primary process. In fact, in some cases, it may be desirable to temporarily and/or removably locate one or more secondary processes in close proximity to the primary process to enable easy assembly and installation, and easy disassembly and removal of the secondary processes.

Figure 4:
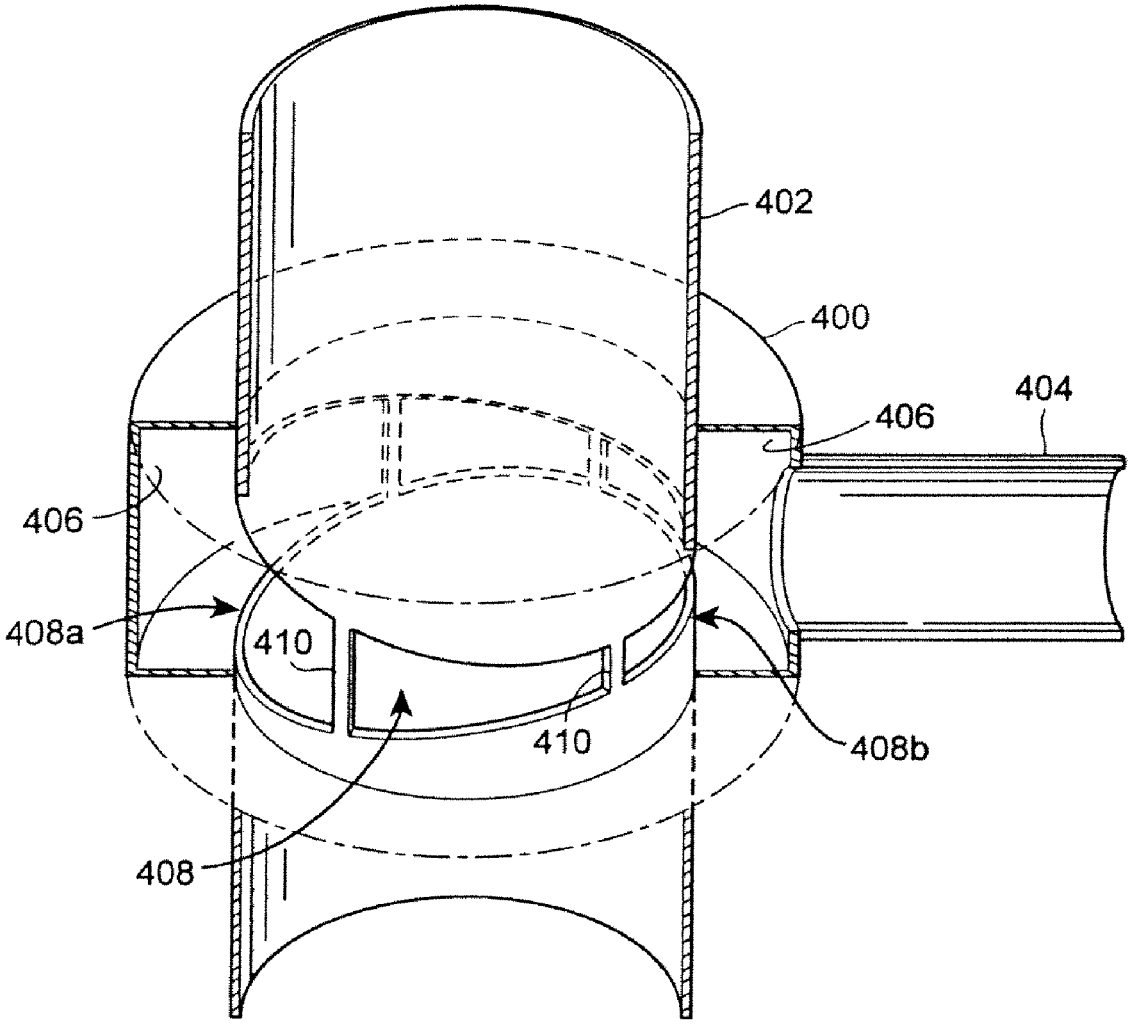
FIG. 4 is a cross-sectional, perspective view of a first stack bustle and pressure control device mounted on a flare or exhaust stack in a manner that facilitates the even or uniform transfer of exhaust gases from a primary process to a secondary process or a heat exchange unit.
Figure 5:
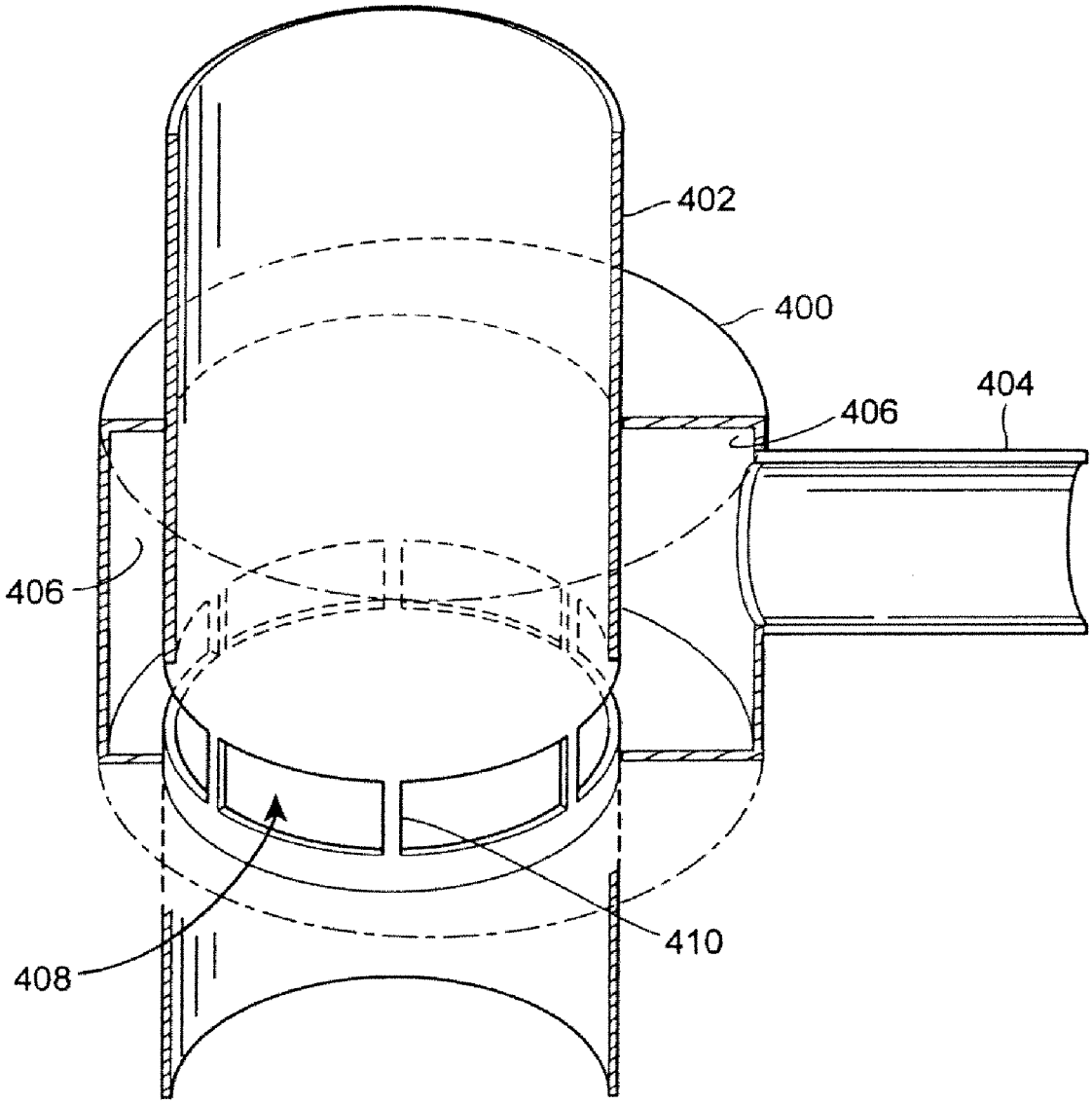
FIG. 5 is a cross-sectional, perspective view of a second stack bustle mounted on a flare or exhaust stack in a manner that facilitates the even or uniform transfer of exhaust gases from a primary process to a secondary process or a heat exchange unit.

FIGS. 4 and 5 illustrate different caps or bustles which may be coupled to the flare or exhaust stacks of FIGS. 1, 2 and 3 to aid in the diversion of exhaust gas from these stacks to the waste heat or energy transfer system. It is desirable, as much as is possible, to divert exhaust gas from the stack of the primary process evenly or uniformly across and around the cross section of the stack to thereby reduce or eliminate undesirable back pressures and induced changes in the flow pattern of gas within the exhaust stack, as such back pressures and induced flows may undesirably affect the operation of the primary process. That is, it is desirable to try to reduce or eliminate changes in the flow of exhaust gas within the stack in the presence of the bustle as compared to the absence of the bustle to thereby assure that the use of the heat transfer system does not cause adverse effects within the primary process.

FIG. 4 illustrates a partially cut-away, cross-sectional view of a stack bustle 400, connected between an exhaust or flare stack 402 and a transfer pipe 404, that operates to draw exhaust gas from the stack 402 in a uniform or approximately equal manner around the periphery (or circumference) of the stack 402. In particular, the bustle 400 includes an outer wall 406 that surrounds or encircles the stack 402 and that is spaced uniformly from the outer wall of the stack 402. However, the stack 402 includes a slot 408 in the wall thereof that varies in height as a function of the distance around the outer circumference of the stack 402 from the center of the transfer pipe 404. Generally speaking, as illustrated in FIG. 4, the height of the slot 408 is the greatest at a point 408*a* of the stack 402 directly opposite the location at which the transfer pipe 404 connects to the bustle 400 and is the smallest at a point 408*b* immediately adjacent the point at which the transfer pipe 404 connects to the bustle 400. Generally speaking, the slot 408 is designed so that the draft generated by the induction fan (not shown in FIG. 4) downstream of the transfer pipe 404 is the same or roughly the same at every circumferential location on the stack 402, so that a roughly equal amount of exhaust gas is transferred from the stack 402 to the bustle 400 (and from there to the transfer pipe 404) at any position around the circumference of the stack 402. Of course the upper portion of the stack 402 may be supported by the bustle 400 or by support braces or members 410 positioned around the circumference of the stack 402 (as shown in FIG. 4) or both.

Generally speaking, the height of the slot 408, i.e., the distance between upper and lower edges of the slot 408 on the outer wall of the stack 402, may vary linearly, circularly, arcuately, exponentially or in any other desired manner around the circumference of the stack 402 to achieve the desired effect of transferring exhaust gas from the stack 402 to the transfer pipe 404 uniformly around the circumference of the stack 402. Of course, the bustle 400 and the stack 402 may be designed to provide even or nearly even suction around the outer edge of the stack 402 in other manners. For example, as illustrated in FIG. 5, the slot 408 within the stack 402 may be constant in size or height, while the outer wall 406 of the bustle 400 may be spaced at varying distances from the wall of the stack 402, depending on the circumferential location of the wall 406 with respect to the entrance of the transfer pipe 404. Here, the outer wall 406 of the bustle 400 is positioned furthest from the stack 402 at the circumferential location at which the transfer pipe 404 connects to the bustle 400, while the outer wall 406 of the bustle 400 is positioned closest to the stack 402 at a circumferential point opposite of the point where the transfer pipe 404 connects to the bustle 400. Once again the distance of the bustle wall 406 to the stack 402 is chosen to produce an even or roughly uniform draft through the slot 408 at any position around the circumference of the stack 402, to thereby minimize the disruption of the flow of exhaust gas within the stack 402 due to the operation of the heat transfer system connected to the transfer pipe 404. If desired, the width of the slot 408 of FIG. 5 could also or instead be made to vary around the circumference of the stack 402, wherein the slot 408 would generally be largest or greatest at the circumferential point at which gas must travel the furthest within the bustle 400 to reach the pipe 404 and the smallest at the point at which the gas must travel the least within the bustle 400 to reach the pipe 404. In this case, the wall 406 of the bustle 400 may be as shown in FIG. 5 or may be configured in a different manner. For example, the wall 406 may be disposed equidistant from the stack 402 around the circumference of the stack 402, or this distance may vary around the circumference of the stack 402 in a manner other than as depicted in FIG. 5. In one example, the distance between the stack 402 and the wall 406 may be the greatest at the circumferential point at which gas must travel the furthest within the bustle 400 to reach the pipe 404 and the smallest at the point at which the gas must travel the least within the bustle 400 to reach the pipe 404.

Figure 6:
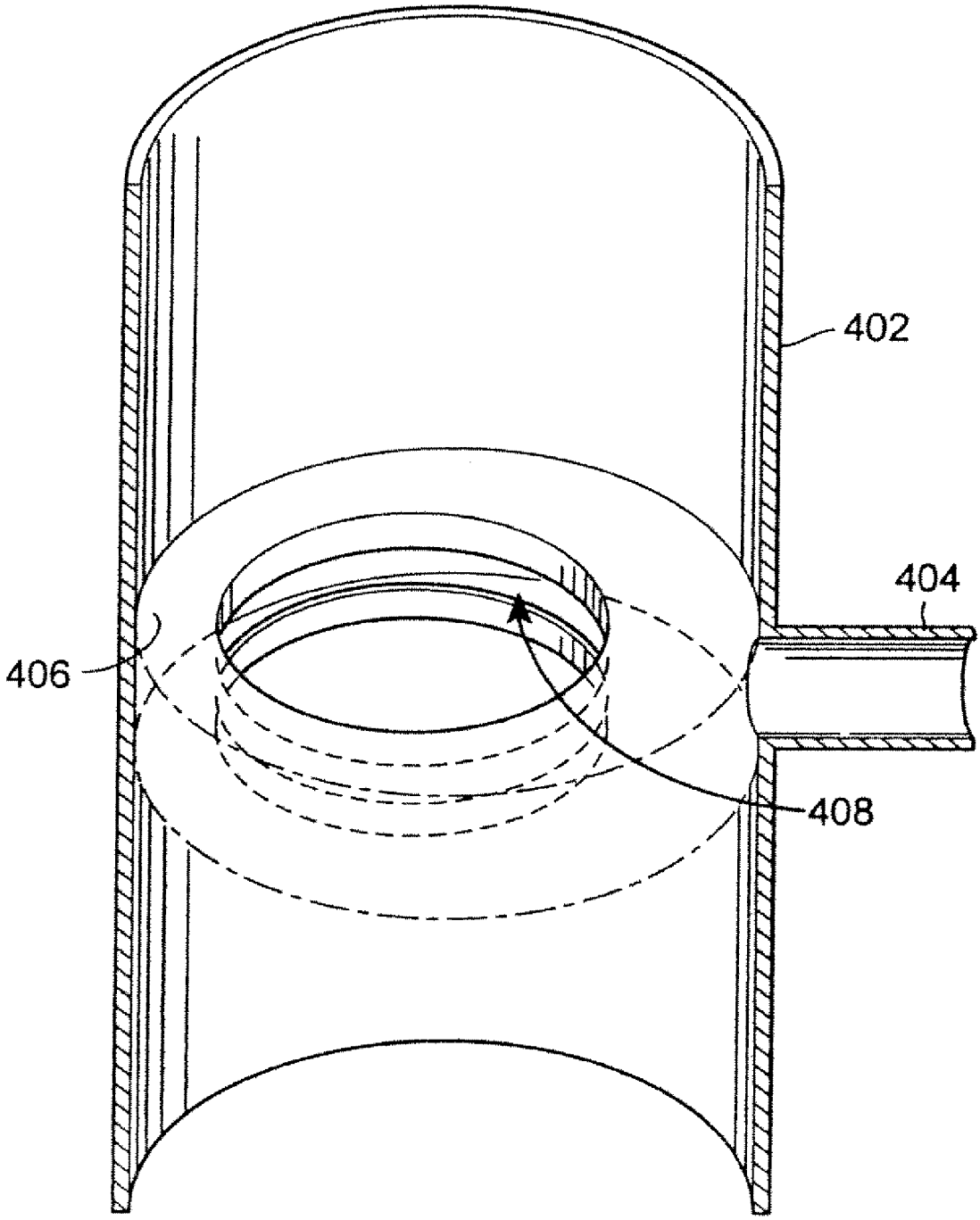
FIG. 6 is a cross-sectional, perspective view of a third stack bustle mounted within a flare or exhaust stack having a uniform slit within a center wall thereof that facilitates the even or uniform transfer of exhaust gases from a primary process to a secondary process or a heat exchange unit.
Figure 7:
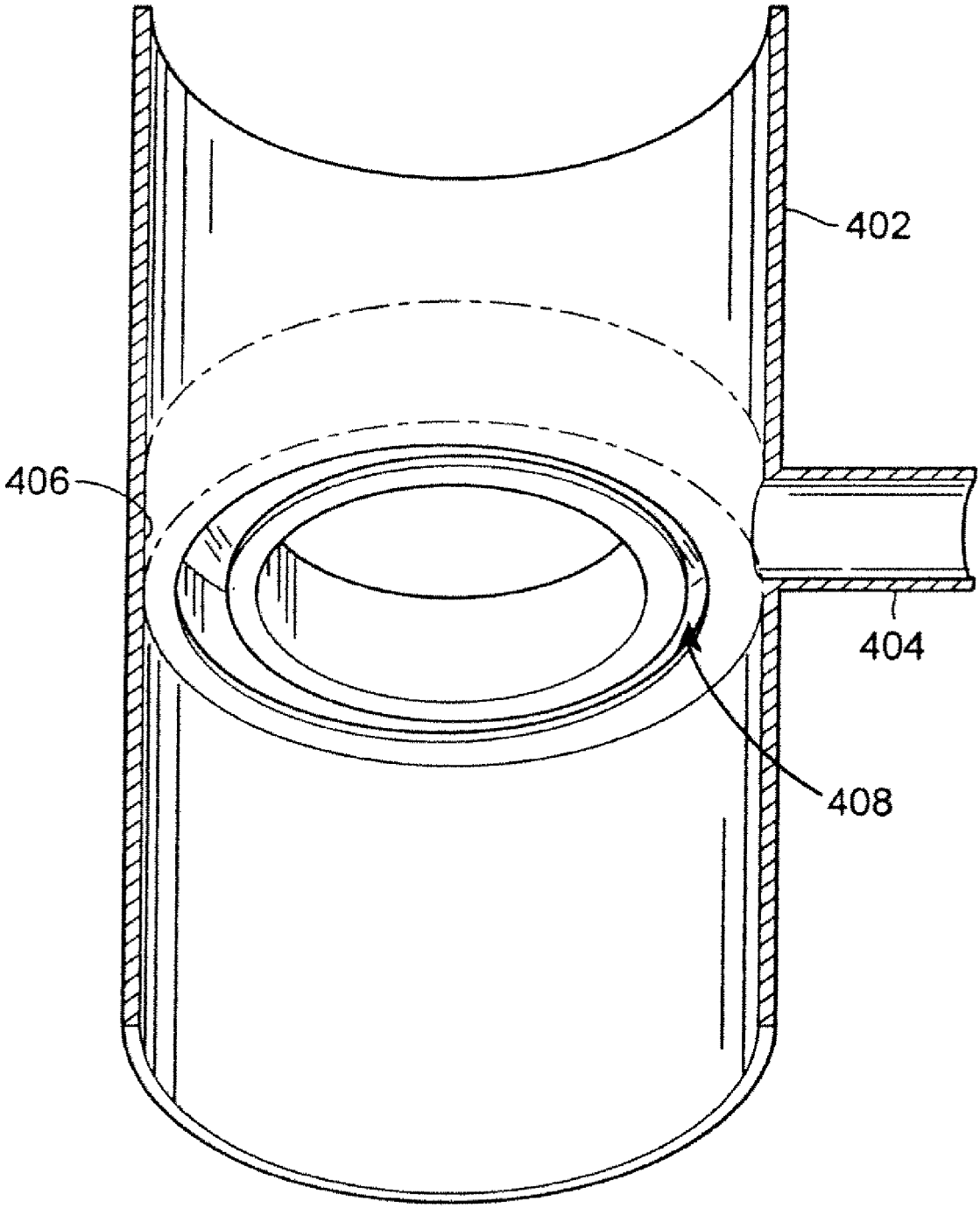
FIG. 7 is a cross-sectional, perspective view of a fourth stack bustle mounted within a flare or exhaust stack having a circumferentially varying slit in a bottom wall thereof that facilitates the even or uniform transfer of exhaust gases from a primary process to a secondary process or a heat exchange unit.
Figure 8:
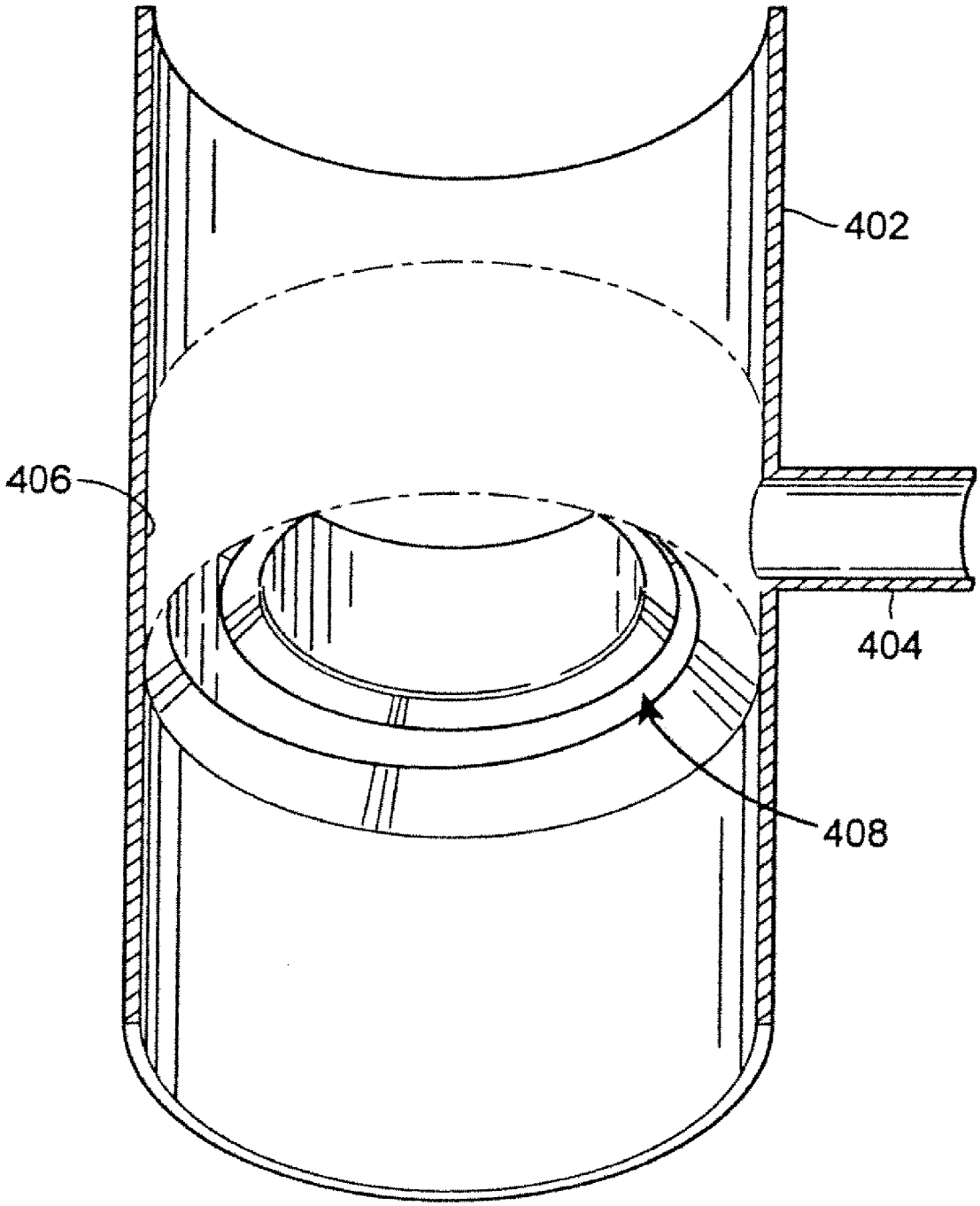
FIG. 8 is a cross-sectional, perspective view of a fifth stack bustle mounted within a flare or exhaust stack having a circumferentially varying slit in a sloped wall thereof that facilitates the even or uniform transfer of exhaust gases from a primary process to a secondary process or a heat exchange unit.

While two stack and bustle designs are depicted in FIGS. 4 and 5 and are described above, other designs could be used as well to produce the desired effect. For example, as illustrated in FIGS. 6-8, the bustle 400 could be disposed on the inside of the stack 402 with the slot 408 being in a wall of the bustle, such as on an inner wall of the bustle as illustrated in FIG. 6, on a bottom wall of the bustle as illustrated in FIG. 7 or on a sloped or tapered wall of the bustle as illustrated in FIG. 8 instead of being in the stack wall. It will be noted that the illustrations of FIGS. 7 and 8 are viewed from a lower perspective to provide a clearer depiction of the bottom walls of the bustle 400. In this and other designs, the slot could be uniform while the spacing between a bustle wall and the stack wall or between two of the bustle walls could vary as a function of circumferential location (see FIGS. 5 and 6), the spacing between various walls could be uniform while the size of the slot could vary as a function of circumferential location (see FIGS. 4, 7 and 8) or both the size of the slot and spacing between various walls could vary as a function of circumferential location (see FIG. 9). Additionally, the slot can be a continuous or nearly continuous opening, such as shown in FIGS. 4-8, or could be made up of or formed of a series of holes, slits, etc. spaced around the circumference of the stack 402 or bustle 400.

Figure 9A:
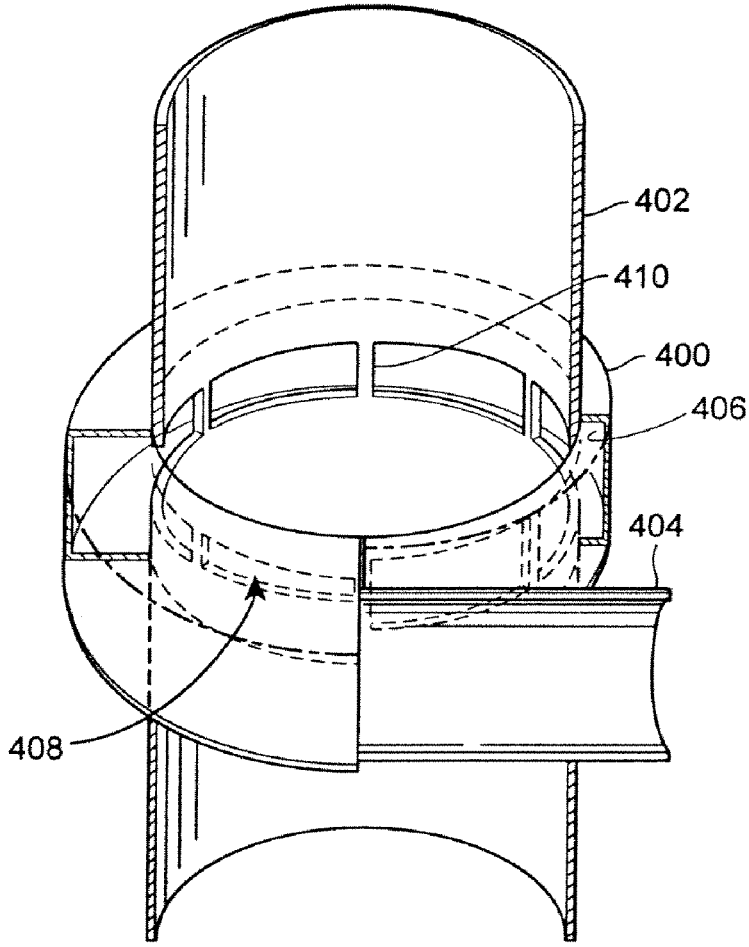
FIG. 9A is a partial cross-sectional, perspective view of a sixth stack bustle mounted on a flare or exhaust stack having a varying cross sectional shape that increases in area around the circumference of the stack to facilitate the even or uniform transfer of exhaust gases from a primary process to a secondary process or a heat exchange unit.
Figure 9B:
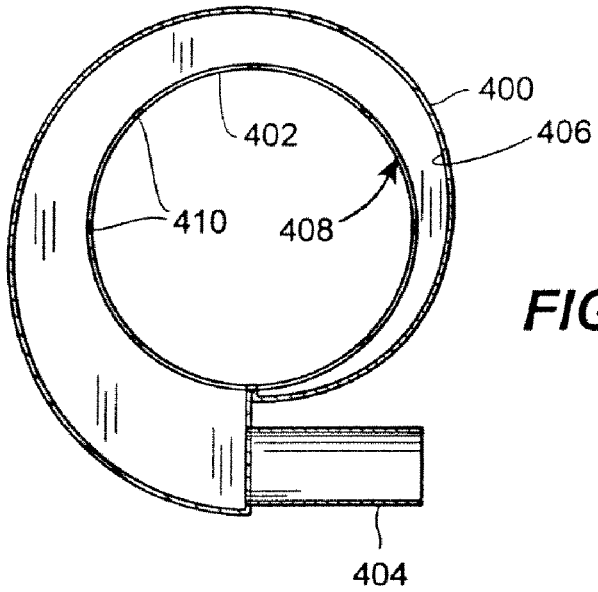
FIG. 9B is a top view of the sixth stack bustle of FIG. 9A.

FIGS. 9A and 9B illustrate a still further bustle design in which the bustle 400 is located on the exterior of the stack 402 and is connected to the interior of the stack 402 by a slot 408 of variable height. FIG. 9A illustrates a perspective, partially cut-away side view of the bustle design while FIG. 9B illustrates a top view of the bustle design. As illustrated best in FIG. 9A, the height of the slot 408 increases as the circumferential distance from the point where the transfer pipe connects to the bustle increases, i.e., as the distance that the gas has to travel within the bustle 400 to reach the transfer pipe 404 increases. Additionally, as illustrated in FIGS. 9A and 9B, the wall 406 of the bustle 400 tapers outwardly or away from the stack wall around the circumference of the stack 402 to form a snail shell like structure. At the location where the transfer pipe 404 connects to the bustle, the point on the inner wall of the transfer pipe closest to the flare stack 402 is within a vertical plane that is approximately tangent to the wall of the stack 402. As can be seen, the transfer pipe 404 connects to the bustle 400 at the end of the bustle 400 where the cross-sectional area formed by the wall 406 of the bustle 400 and the stack wall is the greatest. For each particular application, the variable slot width and variable cross-sectional area of the bustle embodiment of FIGS. 9A and 9B may be configured to divert exhaust gas from the stack 402 to a waste heat or energy transfer system evenly or uniformly across and around the cross section of the stack with only a slight decrease in pressure through the bustle 400. The energy required to operate the induction fan (not shown in FIGS. 9A and 9B) downstream of the transfer pipe 404 is the least when the sum of the decrease in pressure through the combined transfer pipe 404 and the bustle 400 is the least. Therefore the embodiment of FIGS. 9A and 9B provides means to reduce or minimize the amount of electrical or mechanical energy that must be supplied to the induced draft fan to divert exhaust gas from the stack 402 to a waste heat or energy transfer system evenly or uniformly across and around the cross section of the stack. In other words, it is believed that the embodiment of FIGS. 9A and 9B is a highly efficient design in terms of the energy requirement for running an induction fan to create a desired draft within the bustle 400.

Also, while the diameter of the stack 402 is illustrated as being constant along the length of the stack 402 at which the bustle 400 is attached to the stack 402, the diameter of the stack 402 could vary, such as by tapering inwardly, along the length (height) of the stack 402 either before, at or after the location at which the bustle 400 attaches to the stack 402. This tapering feature may be used in conjunction with the slot and wall spacing features described above to force more of the exhaust gas traveling within the stack 402 into the bustle 400 and, thereby, into the transfer pipe 404. Additionally, while the stack 402 and the transfer pipe 404 are illustrated in FIGS. 4 and 5 as being circular in cross section, and the bustle is generally depicted as being rectangular in cross section, these elements could have any other desired or suitable cross-sectional shapes including, for example, elliptical, oval, square, rectangular, circular, conical, etc.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A stack bustle for use in a gas exhaust system having an exhaust stack, the stack bustle comprising:

a circumferential piping section co-extensive with the exhaust stack, the circumferential piping section including an outer wall and an inner wall, the volume between the outer wall and the inner wall defining a flow corridor;

an orifice disposed within the outer wall of the circumferential piping section, the orifice adapted to be connected to a gas transfer pipe for transferring gas from the circumferential piping section; and a slot disposed within the inner wall of the circumferential piping section, the slot forming a fluid passageway between the exhaust stack and the flow corridor, wherein the flow corridor varies in cross-sectional area circumferentially around the exhaust stack and the cross-sectional area of the flow corridor is widest proximate the orifice.

2. The stack bustle of claim 1, wherein the flow corridor forms a first branch that extends clockwise from the orifice and a second branch that extends counterclockwise from the orifice around the exhaust stack.

3. The stack bustle of claim 2, wherein the first and second branches of the flow corridor meet at a location opposite the orifice and the cross-sectional area of the flow corridor is narrowest at the location opposite the orifice.

4. The stack bustle of claim 1, further including a plurality of slots within the inner wall of the stack bustle.

5. The stack bustle of claim 4, wherein the slots are uniform in area.

6. The stack bustle of claim 5, wherein the slots vary in area.

7. The stack bustle of claim 6, wherein slots opposite the orifice have a greater area than slots proximate the orifice.

8. The stack bustle of claim 1, wherein the orifice is substantially tangent to the flow corridor.

9. The stack bustle of claim 1, wherein the orifice is substantially perpendicular to the flow corridor.

10. The stack bustle of claim 1, wherein the inner wall forms a portion of the exhaust stack.

11. The stack bustle of claim 1, wherein the outer wall forms a portion of the exhaust stack.

12. The stack bustle of claim 1, wherein the slot forms a continuous ring around the exhaust stack.

13. A stack bustle for use in a gas exhaust system having an exhaust stack, the stack bustle comprising:

a circumferential piping section co-extensive with the exhaust stack, the circumferential piping section including an outer wall, an inner wall, a top wall and a bottom wall, the outer wall and the inner wall being spaced apart from one another and the top wall and the bottom wall being spaced apart from one another, the inner, outer, top and bottom walls together forming a flow corridor, the inner, top, and bottom walls being located inside the exhaust stack, an orifice disposed in the outer wall to transfer exhaust gases out of the flow corridor, and an opening in the bottom wall, the opening forming a fluid passageway from the exhaust stack into the flow corridor, wherein the circumferential piping section includes an open middle portion through which exhaust gas in the exhaust stack may flow, bypassing the flow corridor, and wherein the opening in the bottom wall is located laterally outward of the open middle portion.

14. The stack bustle of claim 13, wherein the bottom wall includes an angled portion leading into the opening.

15. The stack bustle of claim 14, wherein the angled portion angles the bottom wall upward towards the top wall from the outer wall towards the inner wall.

16. The stack bustle of claim 12, wherein the opening forms a continuous ring.

17. The stack bustle of claim 12, wherein opening varies in width circumferentially.

18. The stack bustle of claim 17, wherein the opening is widest at a location opposite the orifice.

19. The stack bustle of claim 18, wherein the opening is narrowest proximate the orifice.

* * * * *